US011590375B1

(12) United States Patent
Krayeski et al.

(10) Patent No.: US 11,590,375 B1
(45) Date of Patent: Feb. 28, 2023

(54) TEMPORARY SPRINKLER METHOD FOR BUILDINGS UNDER CONSTRUCTION/RENOVATION

(71) Applicants: Timothy Krayeski, Portsmouth, NH (US); Andrew Shetty, New Haven, CT (US); Dale Funk, St. Louis, MO (US)

(72) Inventors: Timothy Krayeski, Portsmouth, NH (US); Andrew Shetty, New Haven, CT (US); Dale Funk, St. Louis, MO (US)

( * ) Notice: Subject to any disclaimer, the term of this patent is extended or adjusted under 35 U.S.C. 154(b) by 400 days.

(21) Appl. No.: 16/996,036

(22) Filed: Aug. 18, 2020

Related U.S. Application Data

(62) Division of application No. 16/049,836, filed on Jul. 31, 2018, now Pat. No. 10,744,358.

(51) Int. Cl.
*A62C 37/36* (2006.01)
*A62C 35/62* (2006.01)
*A62C 3/00* (2006.01)

(52) U.S. Cl.
CPC ..... *A62C 37/04* (2013.01); *A62C 3/00* (2013.01); *A62C 35/62* (2013.01); *A62C 37/36* (2013.01)

(58) Field of Classification Search
CPC ..... A62C 3/00; A62C 35/62; A62C 35/64; A62C 35/645; A62C 37/04; A62C 37/36; A62C 37/44
USPC ..... 169/47, 60, 61
See application file for complete search history.

(56) References Cited

U.S. PATENT DOCUMENTS 5,971,080 A * 10/1999 Loh ..... A62C 35/66 169/17
2006/0021762 A1* 2/2006 Golinveaux ..... A62C 35/60 169/17
2019/0126083 A1* 5/2019 Rock ..... A62C 35/68

* cited by examiner

*Primary Examiner* — Cody J Lieuwen
(74) *Attorney, Agent, or Firm* — Luis Figarella

(57) ABSTRACT

A method of temporarily operating sprinklers and mobile sensors during buildings/facilities alterations, renovations, additions, repairs, rehabilitations, relocations and any other similar activities where personnel may trigger sprinkler systems through accidental actions (or inactions) during their chores. This minimizes the possibility of damages during the building's construction/renovation.

5 Claims, 2 Drawing Sheets

TEMPORARY SPRINKLER METHOD FOR BUILDINGS UNDER CONSTRUCTION/RENOVATION

CROSS-REFERENCE TO RELATED APPLICATIONS

This application is a divisional of U.S. application. "Temporary Sprinkler Method for Buildings Under Construction/Renovation", Ser. No. 16/049,836, filed Jul. 31, 2018 which claimed priority to U.S. Provisional patent application Ser. No. 62/643,363 titled "Temporary Sprinkler System for Buildings Under Construction", filed on Mar. 15, 2018 the disclosure of both herein incorporated by reference in their entirety.

PATENTS CITED

The following documents and references are incorporated by reference in their entirety, Coulthard (U.S. Pat. No. 6,972,677), Hyland et al (U.S. Pat. No. 9,799,204), Hamilton et al (U.S. Pat. No. 1,950,029), Reilly et al (U.S. Pat. No. 7,921,577), Feenstra et al (U.S. Pat. No. 9,776,028), Murphy Jr. et al (U.S. Pat. No. 9,355,552), Becker et al (U.S. Pat. No. 8,484,032), Jackson et al (U.S. Pat. No. 7,383,892) and Golinveaux (U.S. Pat. Pub. No. 2006/0021762).

FIELD OF THE INVENTION

The present invention relates generally to a method for the installation and use of sprinkler systems installed and used temporarily in buildings/facilities under renovation/construction. The method allows the buildings sprinkler system to be made operational while mitigating the risk of water release events due to accidental sprinkler activation through construction/renovation activities.

DESCRIPTION OF THE RELATED ART

Traditionally, the sprinkler system in a building under construction will not be made operational until the construction of the building is nearly complete. The National Fire Protection Association Fire Code states that "if automated sprinkler protection is to be provided, the installation shall be placed in service as soon as is practicable" [NFPA—1 Fire Code (2012) 16.4.3.2 Sprinkler Protection]. Without a practicable solution to the risks described in the next three paragraphs, it has been a widely accepted practice by fire departments and contractors to wait until the end of the construction schedule to activate the buildings permanent sprinkler system.

There are many obvious reasons why a construction company will traditionally wait until the end of the construction schedule to install and activate the permanent fire alarm system and to fill the sprinkler pipes with water. Among them, waiting to install some of the buildings permanent alarm system components until the end of construction helps to ensure that sensitive wiring and fire-detecting components of that permanent system are not subject to damage from surrounding construction activities or from weather/temperature related stress.

A very important and primary reason for a contractor to wait to fill the permanent sprinkler pipes with water is to prevent the possibility of having an accidental water release while the building is under construction. While a building is in the construction phase, it is common for the permanent sprinkler piping, joints, and sprinkler heads to be exposed to the surrounding construction activities from the point that they are first installed to the point that the permanent building sprinkler system is made active or livened. During the construction phase, the potential for those permanent sprinkler system components to sustain physical damage, or for them to be accidentally activated due to a nearby heat related construction activity (e.g. hot work/welding), is much greater than in a permanent setting.

Additionally, the inability to control the air temperature during construction creates a significant issue in the winter in certain climates. If sprinkler pipes are filled with water before the building temperature is able to be controlled, there is a potential for the water to freeze and damage the piping. All of these scenarios could result in materials being damage by water, insurance claims, and/or construction schedule delays. These events are known to cause significant financial losses and operational stress to a construction project.

Unfortunately, the above delay in activating the sprinkler system in order to prevent these water losses, annually results in a large number of fires with significant, and sometimes fatal, losses. What is needed, is a pre-action sprinkler system capable of being deployable and effective under construction conditions.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

In one aspect the invention is about a computer-implemented method for the temporary pre-action construction phase building sprinkler protection, said method comprising operating a control and communication computer component comprising a memory and at least one hardware processor interoperably coupled with said memory, maintaining electronic communication between said control component and a valve or similar electronically activated valve connecting one or more sprinkler riser/branch pipe(s) to one or more main sprinkler input pipe(s), said valve having one or more remotely operated water releasing component(s), activating as required one or more sprinkler riser/branch network pipe pressure creating/maintaining components, monitoring one or more sprinkler riser/branch network pipe pressure sensing components, maintaining electronic communication between one or more remote sensors and said are control and communication computer component and automatically activating said electronic remotely operated water releasing components upon pre-established conditions/status of both said riser pipe/branch pipe network and said remote sensors status, thus connecting said main sprinkler input pipe to said sprinkler riser/branch network of pipe(s). In another aspect, said remote sensors are comprised of one or more from the group comprising: fire, heat human presence, heat rate-of-rise, smoke, Carbon Monoxide, human presence and said electronic communication between sensors and said electronic communication components is accomplished via wired or wireless components. In yet another aspect, said pre-established conditions for the automatic activation of said electronic remotely operated water release components includes the sensing of reduction of pressure within any of the sprinkler riser/branch network of pipe(s) for more than a pre-determined period of time as well as the sensing of fire and/or emergency status from any one or more of said remote sensors for more than a pre-determined period of time.

In another aspect, upon activation of said electronically activated water releasing component, said control and communication component notifies one or more of the following: Fire Department, Operator, Supervisor. In yet another aspect, said pre-established conditions for the automatic activation of said electronic remotely operated water release components includes the sensing of reduction of pressure within any of the sprinkler riser/branch network of pipe(s) for more than a pre-determined period of time after attempting to re-pressurize the pipe(s) through the pressure creating/maintaining component.

In one aspect, the invention is about a method for operating a temporary pre-action construction phase building sprinkler protection system, the system including a temporary control and communication component in electronic communication with a valve or similar electronically activated valve connecting one or more sprinkler riser/branch pipe(s) to one or more main sprinkler input pipe(s), wherein said valve has an electronically activated water releasing component for connecting said one or more main sprinkler input pipe to said one or more sprinkler riser/branch pipe(s), one or more sprinkler riser pipe pressure creating/maintaining component, as well as one or more sprinkler rise pipe pressure sensing components, and one or more remote sensors in electronic communication with said control component, said method comprising, sensing any reduction of pressure within any of the sprinkler riser/branch pipe(s) over a pre-determined period of time, sensing any alarm from one or more of the remote sensors located along the sprinkler riser/branch pipe(s) over a pre-determined period of time and upon confirmation of both a reduction of pressure within the sprinkler rise/branch pipe(s) and a remote sensor alarm, activation of said electronically activated water releasing component. In another aspect, said remote sensors are comprised of one or more from the group comprising: fire, heat human presence, heat rate-of-rise, smoke, Carbon Monoxide, human presence, and said electronic communication between sensors and said electronic communication components is accomplished via wired or wireless components. In yet another aspect, said pre-established conditions for the automatic activation of said electronic remotely operated water release components includes the sensing of reduction of pressure within any of the sprinkler riser/branch network of pipe(s) for more than a pre-determined period of time as well as the sensing of fire and/or emergency status from any one or more of said remote sensors for more than a pre-determined period of time.

In another aspect, upon activation of said electronically activated water releasing component, said control and communication component notifies one or more of the following: Fire Department, Operator, Supervisor. In yet another aspect, said pre-established conditions for the automatic activation of said electronic remotely operated water release components includes the sensing of reduction of pressure within any of the sprinkler riser/branch network of pipe(s) for more than a pre-determined period of time after attempting to re-pressurize the pipe(s) through the pressure creating/maintaining component.

In one aspect, the invention is about a temporary pre-action construction phase building sprinkler protection system comprising a control and communication computer component comprising a memory and at least one hardware processor interoperably coupled with said memory, a valve or similar electronically activated valve having one or more remotely operated water releasing component(s), said valve connected to one or more sprinkler riser/branch pipe(s) and also to one or more main sprinkler input pipe(s), pressure creating/maintaining components, one or more remote sensors, electronic communication components linking said control components, said valve, said pressure creating/maintaining components and/or said one or more remotely operated water releasing component(s), and automatically activating said electronic remotely operated water releasing components upon pre-established conditions/status of both said riser pipe/branch pipe network and said remote sensors status, thus connecting said main sprinkler input pipe to said sprinkler riser/branch network of pipe(s). In another aspect, said remote sensors are comprised of one or more from the group comprising: fire, heat human presence, heat rate-of-rise, smoke, Carbon Monoxide, human presence and said electronic communication between sensors and said electronic communication components is accomplished via wired or wireless components. In yet another aspect, said pre-established conditions for the automatic activation of said electronic remotely operated water release components includes the sensing of reduction of pressure within any of the sprinkler riser/branch network of pipe(s) for more than a pre-determined period of time as well as the sensing of fire and/or emergency status from any one or more of said remote sensors for more than a pre-determined period of time. In another aspect, upon activation of said electronically activated water releasing component, said control and communication component notifies one or more of the following: Fire Department, Operator, Supervisor. In yet another aspect, said pre-established conditions for the automatic activation of said electronic remotely operated water release components includes the sensing of reduction of pressure within any of the sprinkler riser/branch network of pipe(s) for more than a pre-determined period of time after attempting to re-pressurize the pipe(s) through the pressure creating/maintaining component.

Other features and advantages of the present invention will become apparent upon examining the following detailed description of an embodiment thereof, taken in conjunction with the attached drawings.

Figure 1:
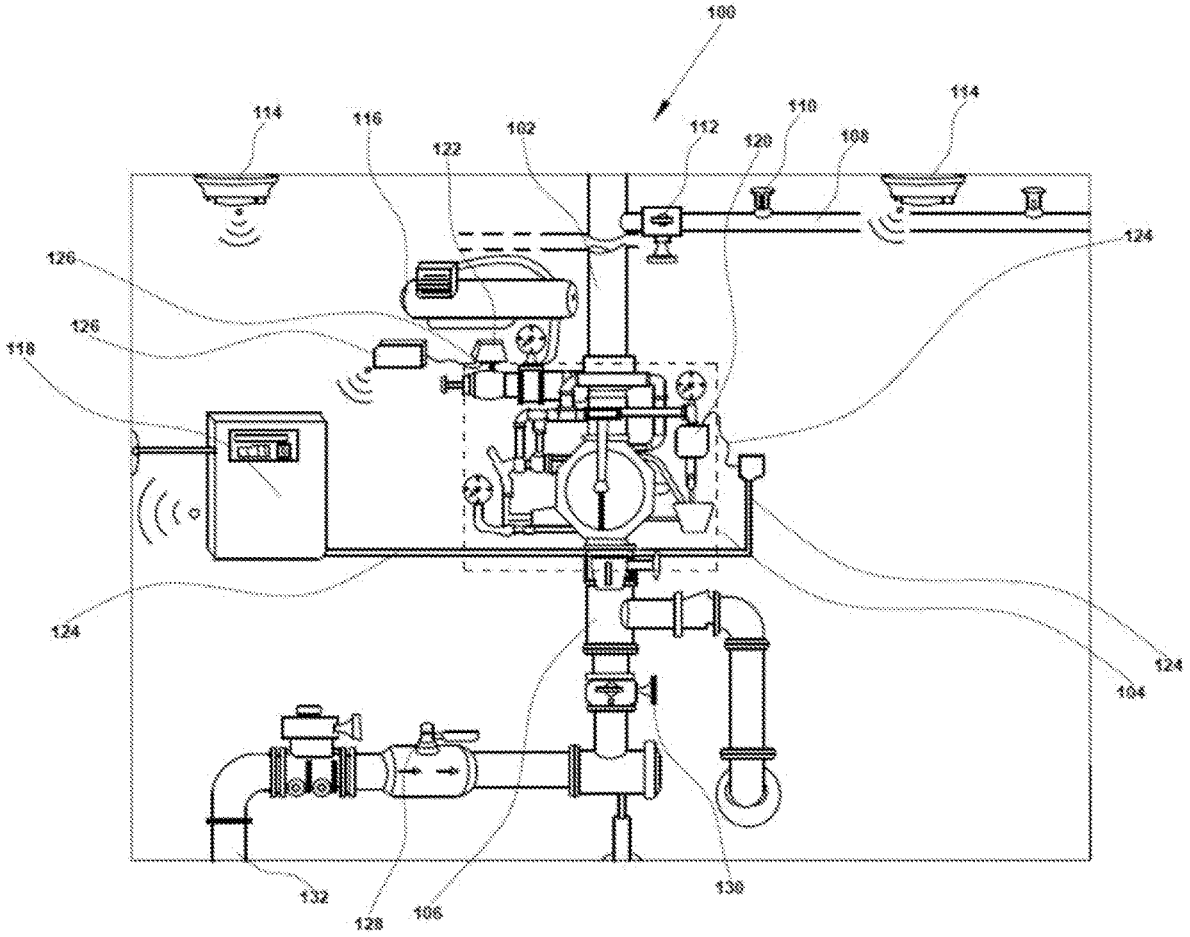
FIG. 1 shows an illustration of a temporary fire sprinkler system, according to an exemplary embodiment of the invention.

The above-described and other features will be appreciated and understood by those skilled in the art from the following detailed description, drawings, and appended claims.

DETAILED DESCRIPTION OF THE PREFERRED EMBODIMENT

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

Simplifications or omissions may be made to avoid obscuring the purpose of the section. Such simplifications or omissions are not intended to limit the scope of the present invention. All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

As used in the specification and claims, the singular forms "a", "an" and "the" include plural references unless the context clearly dictates otherwise. For example, the term "a transaction" may include a plurality of transaction unless the context clearly dictates otherwise. As used in the specification and claims, singular names or types referenced include variations within the family of said name unless the context clearly dictates otherwise.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the modules or any assembly of them may be used.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

When speaking of construction, we include in this definition not only new construction, but also building alterations, renovations, additions, repairs, rehabilitations, relocations and any other similar activities where personnel may trigger sprinkler systems through actions or inactions. We additionally define "Installed" as building materials that have been installed. Such installation may occur during the initial construction of the building or during alterations, renovations, etc. When defining "Permanent" we speak of items that are intended to be used as part of the building's permanent operating systems (e.g. permanent sprinkler system, in one case). Similarly, we define "Temporary" as components of our system that are used during the construction phase but will be removed, possibly replaced, disabled and/or become unused once the building is ready for its permanent system to be made fully active/operational. The term "Construction Phase" refers to the period of time that the building is under construction, is being altered or renovated.

In one embodiment (FIG. 1), the proposed temporary system 100 is comprised of a network of sprinkler delivery pipes. Note the pipes may be themselves temporary, and/or the intended permanent sprinkler network. The sprinkler network is usually comprised of one or more sprinkler risers 102 each having one or more sprinkler branches 108. Note a single branch 108 coming out of the valve 104, is itself a unitary riser/branch combination. During construction/remodeling, the riser/branch network being worked around, is initially filled with a non-damaging first fluid (such as air and/or any other gas mixture) that is compressed within the delivery sprinkler riser 102 and delivery sprinkler branch 108 networks located past a temporarily installed valve 104 (sometimes called a deluge or pre-action type valve) which may be remotely or automatically activated (by the control system 108) and that separates the riser(s) 102 and/or sprinkler branches 108 from the main sprinkler intake pipe 106 which is typically located within the building under construction and is typically supplied from city pressure water lines.

In one embodiment, the valve 104 is in effect comprised of an electronically actuated water releasing component 120 (such as a solenoid or similar), which when activated/released by the control system 118 results in the flow of water from the water supply 106 into the riser/sprinkler branch 102/108, and resulting in the eventual water release to the sprinklers tubes (which include both the sprinkler 110 and/or branch pipe 108 which caused the pressure drop) in the gas. Of course, as soon as the pressure drops, in one embodiment the pressure creating/maintaining component 116 is activated, so that a slow leak is recovered, but a massive leak results in no re-establishment of the pressure. In one embodiment, this pressure creating/maintaining component 116 may be a compressor, air pump, stored gas tank with a controllable release valve, so that the control system 118 or other monitoring electronics may increase/maintain the pressure within riser/sprinkler branch 102/108.

The gas is used as a compressed medium within the riser 102 and/or branches 108 is capable of operating within installed and functional sprinkler branches 108 (the ones that will remain after construction) and that come off the delivery sprinkler standpipe riser 102.

In one embodiment, the butterfly or control valve 112/202 on each floor or in each zone, may be controlled by a temporary solenoid valve that is installed during construction. Floors not being protected, may have one or more butterfly valves 112 (either remotely activated 202 and/or manually activated 112). In one embodiment, the butterfly or control valve 112 would be individually opened or closed when a wireless sensor in that zone or on that floor goes into alarm before, during or after an event.

The sprinkler branches 108 have one or more functioning sprinkler heads 110 that will let go if activated, releasing the pressure within the delivery riser 102 and branch piping 108. In one embodiment, the one or more alarm sensors 114 are either intended to be temporary and removed/disabled with the system removal, in another they may be permanent. These sensors 114 may be fire, heat (both simple presence of heat as well as more sophisticated rate-of-rise heat sensors), smoke, CO (Carbon Monoxide) and/or human absence/presence sensors, although these may be wireless and/or wired units, although in construction sites wireless are preferred, and installed throughout the construction site.

Once the delivery sprinkler riser 102 is filled, leaks may be found if the system is unable to hold the required amount of pressure (e.g. due to that fact that that a butterfly or control valve is open on a floor that contains branch lines that are not yet fully installed or under construction, or via a defective sprinkler installation) Similarly, this may be done through either sound devices or color additives. Once these leaks are resolved, the system may then be declared active and operational. A slow leak, may be resolved by the use of a first fluid pressure creating/maintaining component 116 (say an air/gas compressor, air/gas tank or similar device) as well as pressure sensing components 122 which themselves are connected wirelessly 126 to one or more central control box(es) 118, and any other related hardware installed as temporary components branching off the main sprinkler piping 106.

The temporary control box, component or device 118 comprises a computer unit (having an optional battery backed power supply) having one or more processors, memory and other electronics capable of linking (both wired and wirelessly) with the various sensors 114, 126 and others system components. Note that in some applications, the box 118 functions may be built into the physical assembly of said valve 104. This box 118 unit receives signals from all the various system sensors (including status/faults), and is capable of communicating with both the Fire Department and contractors acting as supervisors via phone/SMS/Text/Apps etc. either via the regular phone lines, voice over IP (VoIP), radio signals, cellular service and/or the internet.

This first fluid pressure maintaining component 116 is activated in order to fill the sprinkler piping 102 beyond the valve 104 throughout the construction site. In one embodiment, the pressure maintaining component 116 will fill this piping 102 to a predetermined amount of compressed first fluid pressure.

Note that in one embodiment, this pipe pressure may not be that of the water system (usually 30 to 80 psi) but may have to be as low as 5 to 20 psi if pipe technology such as PEX (made from HDPE, High Density Polyethylene) or similar has been used. In any case, once the delivery sprinkler main pipe 102 is filled, leaks may be found (through either sound or color additives), ensuring no water damage to the property/site occurs).

In one embodiment, a valve 104 similar to the Tyco DV-5 Deluge Valve 104 (DN50 to DN200) may be used. Note that in an alternate embodiment, the system may be devoid of such pressure sensing and maintaining components, so that activation of the valve 104 simply leads to the sprinkler piping 106 being charged with water, which is then released when a sprinkler activates.

The temporary control and communication panel/device/box 118 is, when activated and installed, electrically connected 124 to the temporary valve 104, and programmed to sync with the one or more alarm sensors 114. As noted before, these alarm sensors 114 may be temporary or permanent. In one embodiment, the sensor location/type may be registered to a particular riser 102 or sprinkler branch 108. In another, not. As these alarm sensors 114 are installed throughout the building as needed, the water supply to the building main sprinkler pipes 106 is turned on but stopped by the valve 104. Since the valve 104 is closed, this water will only fill up to the point in the piping that the temporary valve 104 has been installed, keeping all piping beyond that point in a "dry" state.

In one embodiment, in order for the delivery sprinkler main pipe 102 to fill with water, two events must occur. The first is that one or more of the sprinkler pipes 102 must lose compressed first fluid pressure (triggering a low first fluid pressure alarm) for longer than a pre-determined period of time (which may be zero). The second, that one or more alarm sensor(s) 114 must go into a state of alarm that may be associated with fire and/or emergency status for longer than a pre-determined period of time (which may be zero). The alarm signals from these sensors 114 are sent (again wired or wirelessly) to the temporary control and communication panel/device 118. If those two events occur at/or around the same time, before either event has been remedied (e.g. the pressure maintain/increase component 116 is activated, and/or the sensor 114 is reset or taken out of the alarm state), the temporary control and communication panel device 118 will activate (i.e. open) through the panel's 118 connection to the valve 104 wiring 124, resulting in the energizing/activation of the solenoid or other water releasing component 120.

The above causes the valve 104 to open and fill the appropriate delivery sprinkler pipes 102 with water coming from the main sprinkler pipes 106. Once the delivery pipes are filled 102, water will only be discharged out of the pipes 102 at the location of the fire where a sprinkler head has been released 110. In one embodiment, the 'dual action' activation is automatic, i.e. once both conditions are met, the valve 104 is opened. In alternate embodiments, the unit may be under human supervision after an initial alarm (sound, electric, electronic (e.g. a call or text to a cellphone) during an initial period of time (say 5 minutes), to reduce the typical construction failure.

The above mentioned 'dual event' water activation provides a construction site with protection from accidental water release. Typically, instead of a fire, delivery sprinkler pipes 102 pressure occurs because a sprinkler head 110 or the branch piping 108 gets damaged as a result of construction activities (welding, ladders impact, small fire not requiring water immersion). The loss of pressure, instantly results in the control panel 118 receiving a signal indicating a loss of first fluid pressure. However, since no alarm sensor 114 is in an alarm state, the second interlock requirement fails to be met. In such a case, the valve 104 is not activated and no water is released into the delivery sprinkler piping 102. Alternatively, a welding operation accidentally trips a heat sensor 110, but since the air pressure within the delivery sprinkler piping 102 is not lost concurrently, the control box 118 does not activate the valve 104.

Figure 2:
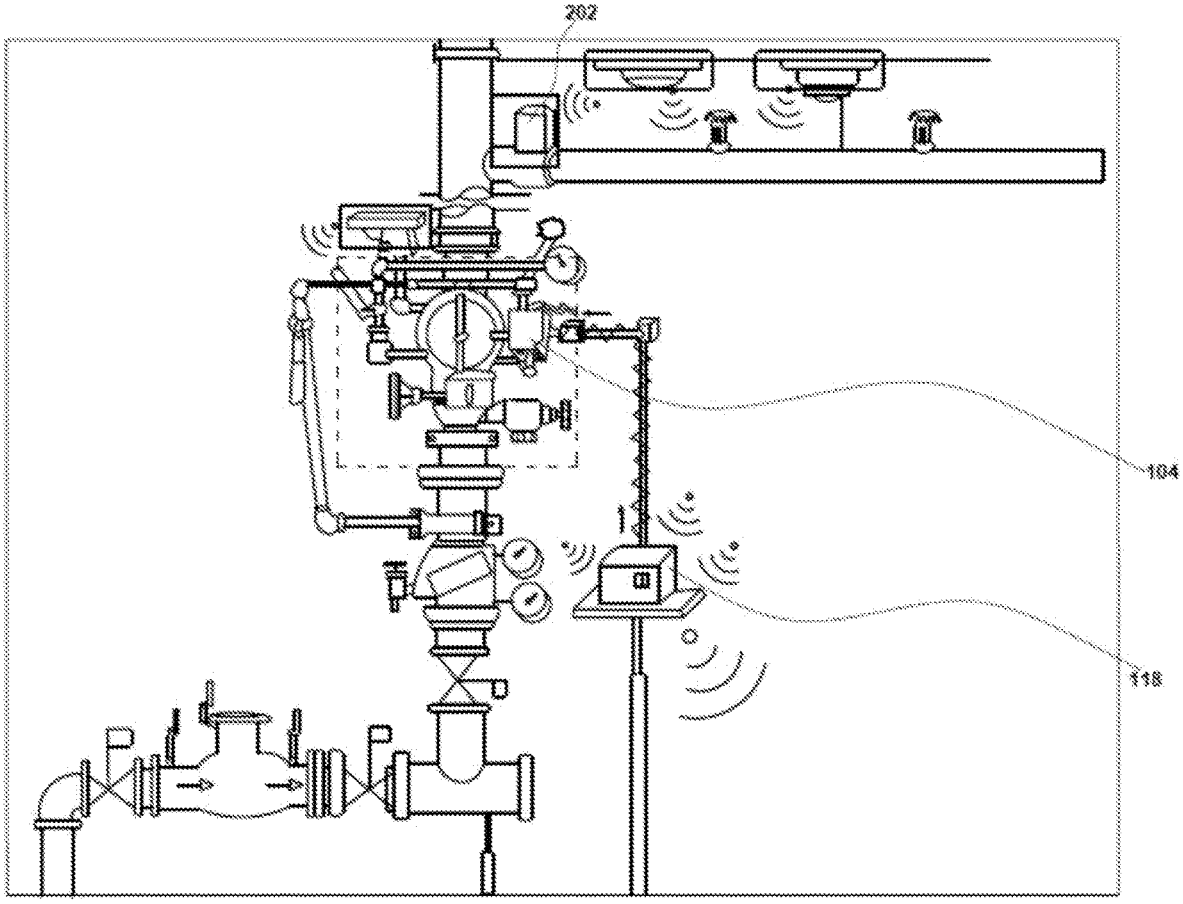
FIG. 2 shows an illustration of a temporary fire sprinkler system, according to an exemplary embodiment of the invention.

The above exemplary application scenario is simply one of many possible "event combinations" that can be utilized to achieve the solution that the system provides. Depending on the logistics of the construction site, it may be more appropriate to incorporate smoke sensors 114 (again wired or wireless) into the system as one of the alarm events rather than heat sensor. FIG. 2 shows another exemplary embodiment.

The alarm sensors 114 may be installed throughout the construction site and can be moved around to prevent conflict with day-to-day construction operations as the building progresses, something that the wireless connectivity nature is suited for. In addition, in one embodiment, the location and status diagnostics (battery level, etc.) of each sensor is registered. In one embodiment, one or more of the sensor(s) 114 failing to register their 'normal' status may be taken as a faulty condition, and trigger a preventive alarm/warning to the operator/supervisor of the system (without water deluge release). All the above may be done while simultaneously communicating critical, real time system information with fire departments and contractors.

A significant cost benefit is that all temporary devices are removed at the completion of construction and may be retained and reused by the contractor. In one embodiment, the temporary control and communication panel 118 logs all the alarm events and communicates these to one or more operators and/or control centers (local or remote). This communication may be done via Internet (Wired and/or Wireless), Telephone (again, wired and/or wireless), SMS texting, Internet Messaging (Including services such as WhatsApp, Facebook, etc.), so that one or more supervising operators may receive emergency signals and intervene.

When the building is seen ready to use, the above temporary system may be uninstalled by one or more of the following steps, including the removal of the sensors, the removal of the control unit 118 and the removal of the valve 104, followed by the filling of the piping 108 with water. At times when there is a desire to repair/renovate or modify all or parts of the bldg., the system may be retrofitted to the bldg. so that one or more floors may temporarily protectable as shown and damage from inadvertent sprinkler head damage or other.

In one embodiment, this invention forms a system that combines with the building's water line, its own sprinkler components and/or all or parts of a building's permanent sprinkler system with temporary system sensors or devices, sprinkler system activation devices and materials, allowing for a fire prevention system to be made operational during the construction phase. In some cases, these may include components of the permanent sprinkler protection system that are not in use yet and/or have been removed/disabled during the construction phase. In fact, in some cases the temporary system may be a standalone unit capable of being left in place as a free-standing system.

The non-obvious nature of this system lies in how it incorporates the permanent materials with the temporary fire sensing and communication equipment, allowing them all to communicate together in a way that uniquely provides both fire and water damage protection for a building that is under construction. To achieve those protections, the system is designed as a multiple-interlock (pre-action) system, that requires alarm signals to be received from at least two separate temporary sensors before any water fills the sprinkler pipes.

In one embodiment, some of the temporary components of the system may include:

wireless fire/heat sensing devices 114
wireless smoke detecting devices 114
wireless devices that monitor air pressure check valves 126
air compressor with a regulator 116
valve 104
temporary control and communication panel/device 118

Similarly, the permanent or non-temporary components of this system may include:

permanent sprinkler piping 102/106/108
control shut-off valves 128/130
sprinkler heads 110
and the water supply 132

The above described system could be used during various stages of construction particularly all those that include any modification from the normal use, particularly those where climate control may be compromised and/or disabled. At these times, the "installed" sprinkler pipes may not be filled with liquids, since they could freeze and burst. Thus, the use of gases as leak detection would result in freeze resistant leak detection means.

An essential goal of this system is to install it as early as possible during construction, specifically right after the first sprinkler has been installed. Every building is different (as is every renovation), but usually you'll need the main structure to be underway and the stairwells to be built in order for the standpipe riser to be installed. As an example, if a building is 10 stories tall, you may begin to install sprinklers on floors 2-4 before the 10th floor has even begun being built. So, in one embodiment, this would include the construction schedule and coordination to consider sprinkler installation as a "critical path" schedule item in order to ensure that this system is made ready as soon as possible.

CONCLUSION

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the foregoing description of embodiments.

We claim:

1. A method for providing a temporary pre-action construction phase building sprinkler protection system, said method comprising:

operating a temporary control and communication computer component comprising a memory and at least one hardware processor interoperably coupled with said memory;

maintaining electronic communication between said temporary control communication computer component and a temporary pneumatic or pneumatic-electric activated valve connecting one or more sprinkler riser/branch pipe(s) to one or more main sprinkler pipe(s), said temporary pneumatic or pneumatic-electric activated valve having one or more remotely operated water release component(s);

activating as required one or more said sprinkler riser/branch pipe(s) pressure creating/maintaining components;

monitoring the pressure in one or more said sprinkler riser/branch pipe(s);

providing one or more remote sensors and maintaining electronic communication between said remote sensors and said temporary control and communication computer component;

automatically activating said temporary pneumatic or pneumatic-electric activated valve upon pre-established conditions/status of both one or more of said sprinkler riser/branch pipe(s) and one or more of said remote sensors' status, thus connecting one or more of said main sprinkler input pipe(s) to one or more of said sprinkler riser/branch pipe(s); and removing said temporary pneumatic or pneumatic-electric activated valve at the completion of the construction phase;

filling the one or more sprinkler riser/branch pipes(s) with water; and retaining said temporary pneumatic or pneumatic-electric activated valve for reuse.

2. The method of claim 1 wherein;

said remote sensors are comprised of one or more from the group comprising: fire, heat human presence, heat rate-of-rise, smoke, Carbon Monoxide, human presence; and said electronic communication between said remote sensors and said control communication computer component is accomplished via wired or wireless components.

3. The method of claim 2 wherein;

said pre-established conditions/status for the automatic activation of said temporary pneumatic or pneumatic-electric activated valve includes:

the concurrent sensing of reduction of pressure within any one or more of said sprinkler riser/branch pipe(s) for more than a pre-determined period of time as well as the sensing of fire and/or emergency status from any one or more of said remote sensors for more than a pre-determined period of time.

4. The method of claim 3 wherein;

upon activation of said temporary pneumatic or pneumatic-electric activated valve, said control and communication computer component notifies one or more of the following: Fire Department, Operator, Supervisor.

5. The method of claim 4 wherein;

said pre-established conditions/status for the automatic activation of said temporary pneumatic or pneumatic-electric activated valve includes the sensing of reduction of pressure within any one or more of the sprinkler riser/branch pipe(s) for more than said pre-determined period of time after attempting to re-pressurize the sprinkler/riser pipe(s).

* * * * *